US005691961A

United States Patent [19]

Paranjpe

[11] Patent Number: 5,691,961

[45] Date of Patent: Nov. 25, 1997

[54] RIBBON CONSERVATION IN THERMAL PRINTING

[76] Inventor: Suresh C. Paranjpe, 5625 Summit Dr., West Linn, Oreg. 97068

[21] Appl. No.: 404,484

[22] Filed: Mar. 17, 1995

Related U.S. Application Data

[63] Continuation-in-part of Ser. No. 318,240, Oct. 5, 1994, which is a continuation-in-part of Ser. No. 236,423, May 2, 1994, abandoned, which is a continuation-in-part of Ser. No. 300,698, Sep. 2, 1994, which is a continuation-in-part of Ser. No. 47,144, Apr. 12, 1993, which is a continuation-in-part of Ser. No. 039,871, Mar. 30, 1993, which is a continuation-in-part of Ser. No. 163,325, Dec. 7, 1993.

[51] Int. Cl.[6] ..... B41J 35/20; B41J 2/325

[52] U.S. Cl. ..... 347/217; 347/171

[58] Field of Search ..... 347/217, 171; 400/240.3

[56] References Cited

U.S. PATENT DOCUMENTS

| | | | |
|---|---|---|---|
| 4,115,805 | 9/1978 | Morton | 358/107 |
| 4,115,806 | 9/1978 | Morton | 358/107 |
| 4,385,302 | 5/1983 | Moriguchi et al. | 346/76 |
| 4,408,212 | 10/1983 | Moriguchi et al. | 346/76 |
| 4,410,897 | 10/1983 | Moriguchi et al. | 346/76 |
| 4,462,704 | 7/1984 | Kurata et al. | 400/120 |
| 4,533,596 | 8/1985 | Besselman | 428/341 |
| 4,562,443 | 12/1985 | Matsuno et al. | 346/76 |
| 4,566,125 | 1/1986 | Clunn | 382/51 |
| 4,652,154 | 3/1987 | Horiya et al. | 400/120 |
| 4,704,615 | 11/1987 | Tanaka | 346/76 |
| 4,736,109 | 4/1988 | Dovorzsak | 250/566 |
| 4,797,016 | 1/1989 | Lahr | 400/237 |
| 4,815,872 | 3/1989 | Nagashima | 400/120 |
| 4,863,297 | 9/1989 | Fujii | 400/249 |
| 4,893,951 | 1/1990 | Iwatani et al. | 400/225 |
| 4,970,531 | 11/1990 | Shimizu et al. | 346/76 |
| 5,064,301 | 11/1991 | Nakamura et al. | 400/120 |
| 5,066,151 | 11/1991 | Durr et al. | 400/605 |
| 5,073,053 | 12/1991 | Kashiwagi | 400/240.3 |
| 5,081,596 | 1/1992 | Vincent et al. | 395/104 |
| 5,089,831 | 2/1992 | Ito et al. | 346/76 |
| 5,129,014 | 7/1992 | Bloomberg | 382/48 |
| 5,140,340 | 8/1992 | Stephenson | 346/1.1 |
| 5,140,674 | 8/1992 | Anderson et al. | 395/111 |
| 5,167,456 | 12/1992 | Murakoshi et al. | 400/120 |
| 5,185,673 | 2/1993 | Sobol | 358/296 |
| 5,344,808 | 9/1994 | Watanabe et al. | 503/227 |

FOREIGN PATENT DOCUMENTS

| | | |
|---|---|---|
| 361 780 | 9/1989 | European Pat. Off. . |
| 56-5775 | 1/1981 | Japan . |
| 60-763377 | 4/1985 | Japan . |
| 62-184528 | 7/1987 | Japan . |

OTHER PUBLICATIONS

G.N. Baker and J.M. Dunn, IBM Technical Disclosure Bulletin, "Multicolor Printing", vol. 22, No. 7, Dec. 1979.

*Primary Examiner*—Huan H. Tran

*Attorney, Agent, or Firm*—Marger, Johnson, McCollom & Stolowitz, P.C.

[57] ABSTRACT

A method of improving ribbon usage, i.e. reducing ribbon waste, in a non-impact color printer of the type that employs a continuous ribbon having panels of transfer material is described. The method includes defining an plurality of sectors across the width of the ribbon, at least one of the sectors including a region having a width less than a total width of the panel. The ribbon sector thus defined extends laterally adjacent to another sector of the same panel. The size and location of an image to be printed is determined; next one or more of the unused sectors of the panel is selected that provides an area of the panel having adequate width and location for printing the image. This unused sector of the ribbon may well be laterally adjacent or next to a used sector. Next the image is printed onto a substrate using the selected sector(s). Finally, an indication of the sector usage is recorded for each of the sectors that it is used for printing to facilitate the subsequent identification of used and unused sectors of ribbon panels.

9 Claims, 8 Drawing Sheets

FIG.7b

RIBBON CONSERVATION IN THERMAL PRINTING

RELATED APPLICATIONS

This application is a continuation-in-part of applicant's co-pending application Ser. No. 08/318,240 filed Oct. 5, 1994 which is a continuation-in-part of application Ser. No. 08/236,423 filed May 2, 1994, now abandoned, which is a continuation-in part of co-pending application Ser. No. 08/300,698 filed Sep. 2, 1994 which is a continuation-in-part of co-pending application Ser. No. 08/047,144 filed Apr. 12, 1993 which is a continuation-in-part of co-pending application Ser. No. 08/039,871 filed Mar. 30, 1993 which is a continuation-in-part of co-pending application Ser. No. 08/163,325 filed Dec. 7, 1993.

FIELD OF THE INVENTION

The present invention pertains to the field of printing, and more specifically relates to printing systems that receive or generate digital image data or "source data," and responsive to such source data (and optionally other inputs) form a relatively permanent print on a substrate such as paper or an overhead transparency. The present invention is especially useful in non-impact color printing systems such as thermal printers or any system where improvements in ribbon consumption are needed because the ribbons are expensive.

BACKGROUND OF THE INVENTION

In ink-jet printing, ink is applied selectively to a substrate only in the areas which are to be printed. Thus, no ink is used in the unprinted areas and therefore it is not wasted. Similarly in laser printing, toner is applied only in the area which is to be printed and toner is not applied to the unprinted area of the substrate and therefore is not wasted. However, in thermal transfer printing, an entire ribbon panel is deemed "used" and therefore cannot be used again even when only a small portion of the panel is actually used for printing. For example, in an A4 size (210 mm×297 mm) color printer, each yellow, magenta, and cyan color panel is 210 mm wide and 297 mm long. Whenever these panels are used for printing a smaller, say 100 mm×275 mm color image, then about half the area of the color panels are wasted. Because of this waste, thermal transfer printing is not as competitive as ink jet and laser printing and therefore is avoided in many potential applications.

In the prior art, use of the thermal printer has been beneficial only when the area to be printed approximately equaled the size of the ribbon panel. If in the thermal piling the print job requires printing an area that is smaller than the ribbon panel, then the rest of the panel is wasted. If the images are significantly smaller, then it may be more efficient to use a smaller size ribbon panels, however throughput in such a case is low.

During conventional thermal printing, the ribbon is wound on a take-up ribbon roll which is driven by the ribbon motor so that the ribbon is advanced. Reversible motors have been used to drive supply ribbon roll as well as take up ribbon roll. The ribbon can be rewound on ribbon supply roll and in such a case, the used portion of panels may be present on the ribbon supply roll. It is also known to track longitudinal position of the ribbon in a printer (i.e. the length of the ribbon advanced from the supply told by means such as an optical encoder mounted on a shaft of a roller driven by ribbon as the ribbon moves. Referring to FIG. 5, optical marks such as marks 501, 511, and 521 indicate the leading edge of the panel. Also, to distinguish the first panel of a repeating panel set (e.g. yellow, magenta, cyan), a different mark 501 (as compared to 511 and 521) is also used. After sensing the mark 501 by an optical sensor, the ribbon can be wound on the take up roll and by counting the encoder signals, the ribbon displacement can be computed.

In another known method of tracking position along the edge of a ribbon, next to the optical mark 501, a series of black and white stripes (e.g. 1 mm) are marked in the marking field. In this method, the optical mark 501 is first sensed and then as the ribbon is moved, the number of stripes passing under the optical mark is counted so that the displacement of the ribbon after sensing the optical mark 501 is determined. Thus, it is known to determine longitudinal ribbon displacement in general, and to detect the top of each panel and each panel set.

Unfortunately, prior art systems waste a great deal of ribbon as illustrated next. FIG. 1*a* illustrates a print 100 comprising three elements, a color image 103, a special texture (e.g. gold, silver) image 105 and a larger, black and white (or other monochrome) image 107 printed on a single substrate 101. A color panel 202 of a ribbon 200 is shown in FIG. 2*a*. The substrate 101 is roughly the same size as the ribbon panel 200. FIG. 2*a* also shows a portion 203 of the panel 202 and marked area 204 in the marking field. We assume that the image of FIG. 1*a* is to be printed repeatedly on multiple substrates without changing the set of panels.

According to the prior art, as exemplified by Kikuchi (JP 63-257674 application), as a portion 203 of color panel 202 is used up to print image 103, area 204 in the marking field is also marked. After the ribbon is rewound, when the ribbon again advances for printing, the "used mark" 204 is sensed by a read head, a the ribbon panel length corresponding to the length of mark 204 is not used for printing any additional images. When the mark 204 moves past the read head, then no mark is sensed in the marking field, and printing is commenced to print another image. This unused length below the used length can be thus used to print another color image 103. Referring next to FIG. 2*b*, image 103 is printed again, this time using a second portion 213 of the ribbon panel. Accordingly, a second area 214 in the marking field is also marked to indicate that the corresponding length of the panel is used up.

Sometimes multiple images are identical when, for example, a business card is printed repeatedly on a single substrate. (The image data may be formed by a step and repeat process.) Sometimes various small color images are printed on one substrate. To illustrate, FIG. 1*b* shows 12 color pictures (e.g. 113) printed on a card substrate 111 (of size 210 mm×297 mm) for 12 business cards 116 (of size 51 mm×89 mm each) by a ribbon panel 222 shown in FIG. 2*c*. The partially used ribbon panel 222 is advanced and used to print a second set of similar 12 color pictures is then shown again as used panel 232 in FIG. 2*d*. Partially used panel 232 is further advanced and used again to print a third set of similar 12 color pictures and then is shown as the used panel 242 in FIG. 2*e*. It can be seen that there is still about 50% of the ribbon panel not used up; namely the ribbon area left of each of the columns of images. According to the prior art, this unused portion of the ribbon cannot be used for printing because "used marks" such as 224, 234, and 244 indicate that the corresponding lengths of the panel 242 have been used up.

The problem remains, therefore, to reduce ribbon waste, i.e. to use a ribbon more completely, thereby reducing the net cost per unit area of thermal transfer color printing.

It is therefore an object of this invention to provide more complete use of a ribbon.

Another object of the invention is to analyze image data so that unused portions of a ribbon can be used to print desired images. Another object of the invention is to position the ribbon and/or substrate so that a previously unused portion of the ribbon can be used to print on the desired location on the substrate. Another object of this invention is to position the image so that a small panel ribbon can be more efficiently used to print desired images.

According to one aspect of the invention, a ribbon panel is partitioned so as to define a plurality of panel sectors, each sector having a width less than the full printable width of the ribbon. In other words, sectors are formed by a series of imaginary lines extending parallel to the edge of the ribbon. Sectors are of arbitrary length, limited only by the length of the panel. However, it is convenient to divide each panel into a rectangular array of rectangular sectors. Regardless of dimensions, the sectors must be contiguous to accommodate printing of images larger than any one sector. Usage of individual sectors of the panel for printing are recorded, either on the ribbon itself ("used sector marks") and/or in a "usage map" stored in a memory. Thus, on the ribbon marking area, for example, there will be more than one sector marker at each longitudinal location, each marker or marking area corresponding to a respective one of the individual sectors, as illustrated in FIG. 3*c*.

The invention thus includes a method of improving ribbon usage in a non-impact color printer. According to one aspect of the method, we assume a continuous ribbon is installed in the printer, the ribbon formed of at least one panel of transfer material of predetermined width. This may be, for example, the common thermal transfer type of ribbon for transferring a predetermined image onto a substrate such as a sheet of paper. The new method includes the steps of, first, selecting a predetermined image to be printed onto a substrate using the installed ribbon. Next I partition a panel of the ribbon so as to define an plurality of sectors, at least one of the sectors including a region having a width less than a total width of the panel. In other words, at least a part of the sector extends laterally adjacent to another sector of the same panel. Ribbon panels have not been divided into laterally adjacent sectors before. The next step is determining the size and location on the page of the image to be printed. We the system selects one or more unused sectors of the panel that provide an area of the panel having adequate size and location for printing the image. Next the image is printed onto the substrate using the selected sectors; and then the system records an indication of usage for each of the sectors that it is used for printing, thereby defining used and unused sectors of the panel. This recording used and unused sectors can be done on the ribbon itself, or stored in a memory, as further explained below.

The foregoing and other objects, features and advantages of the invention will become more readily apparent from the following detailed description of a preferred embodiment which proceeds with reference to the drawings.

BRIEF DESCRIPTION OF THE DRAWINGS

The preferred embodiments of the inventions will now be described in detail with reference to the accompanying drawings, in which.

DETAILED DESCRIPTION OF A PREFERRED EMBODIMENT

A first aspect of the present invention is a method of printing that improves ribbon usage by reducing waste. Toward that end, the method includes partitioning a color panel of a ribbon so as to define a regular array of rectangular ribbon sectors, such as those sectors illustrated in FIG. 3*a*–3*c*. The sectors are not necessarily physically marked in the printing area of the ribbon as the printing area should be contiguous; rather they are "logical" regions identified by corresponding "used marks" in the margin of the ribbon or stored in a memory as explained later. The sectors need not have any particular size or shape, although each sector must have a width less than the full printing width of the ribbon panel. Length of a single sector is limited by the panel length. They need not be of equal size, although for simplicity of illustration equal-sized sectors are shown. Preferably, each panel of a ribbon is partitioned into sectors in the same manner. This is not required, however. It may be useful in some applications to have, e.g. alternating panel sets, one set having finer sectors than the other. It is important to note that the sectors are defined and managed by the printing system described herein, so they can be defined under software or user control. Thus, the sectors preferably are not predetermined during manufacture of the ribbon. To the contrary, the present invention can be used in connection with known, commercially available ("off-the-shelf") ribbons such as thermal transfer ribbons.

Figure 3A:
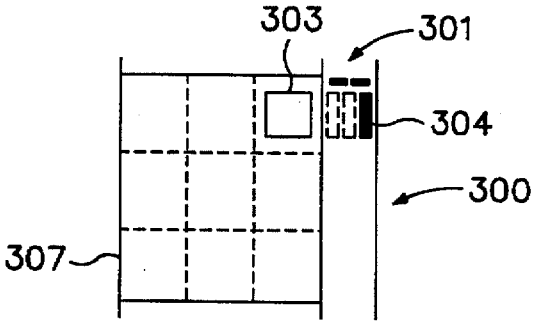
FIG. 3*a* shows a plan view of a ribbon partitioned into predetermined "sectors" according to the present invention and illustrating a single "used sector mark" located in the margin of the ribbon for indicating that a corresponding one of the sectors has been used in printing.
Figure 3B:
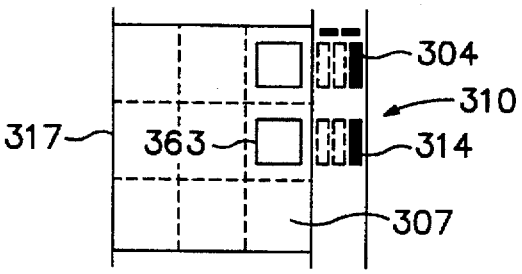
FIG. 3*b* shows a plan view of a ribbon including two used sectors of the ribbon and two corresponding "used sector marks".
Figure 3C:
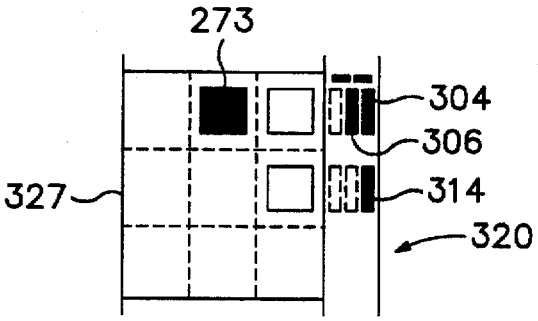
FIG. 3*c* shows a plan view of a ribbon including three used sectors of the ribbon and three corresponding "used sector marks".

FIG. 3*a* shows ribbon 300 in which ribbon panel 307, optical panel mark 301, used sector 303 are shown. Right top ribbon "used mark" 304 corresponds to the right top used sector 303 of the ribbon panel. FIG. 3*b* shows right central ribbon used mark 314 corresponding to right central used sector 363 of the ribbon panel 317. FIG. 3*c* shows another used mark 306 corresponding to used sector 273 of the panel 327. Note that sector 273 is laterally adjacent (i.e. in the same "row" of sectors as) a previously used sector, the previously used sector corresponding to marking 304. Thus, according to this method, a discriminating mark is made in a corresponding marking field for each sector of the ribbon. This discriminating mark can be made by any method such as punching a hole, discoloration in the area or a magnetic mark indicating "used" information. When another image such as image 103 is printed, another mark 314 (FIG. 3*b*) is made in the marking field corresponding to that sector 363 of the panel 317. After printing the second image 103 as described above, if the ribbon is rewound and the read head reads only the mark 304 during the ribbon advance, the microprocessor in the printer determines that sector 303 of the panel 307 is used up and the top left and top middle sectors of the panel remain unused. Therefore another image 403 shown in FIG. 4 which is situated in the middle is printed (if so required) and corresponding mark 306 is marked in the marking field as illustrated in FIG. 3*c*. Similarly, the unused left top sector can be used for printing. Similarly unused left middle sector and near left sectors situated next to the used sector 363 of the ribbon panel can be used to print other images. Thus the present invention makes it possible to use the unused portions situated adjoining the used portion of panel to print additional image(s). This method thus allows more complete use of the unused portion of panel.

The three marks shown in FIG. 3*a*, 3*b* and 3*c* are not unique and therefore may not be discriminated from other similar marks indicating used sectors. Thus, just by sensing these marks, the position of the print head with respect to other unused portions can not be determined. By scanning serially all these marks, a map of the used/unused portion of the ribbon in the memory can be made; however when the printer is turned off and then turned on again, just sensing any mark or even a few sets of marks can not determine the position of the print head with respect to the other unused portions of ribbon panel. This is because inadvertently the ribbon may be moved when the printer is turned off and in such case this movement is not sensed and accounted for. Sensing of one mark does not differentiate it from similar marks elsewhere in the marking field. Since the positional information of the ribbon's panels and set of panels with respect to the position of the print head is not always known, the "search" for the unused portion of the ribbon panel cannot be done and therefore the direction to wind or unwind the ribbon can not be determined.

One limitation of this method is that if a print job requires printing all images on the left hand side, then the right hand side portion of the ribbon panel is wasted. Similarly if all images are to be printed on the right hand side, then all of the ribbon panel's left hand side unused portion is wasted.

Figure 5:
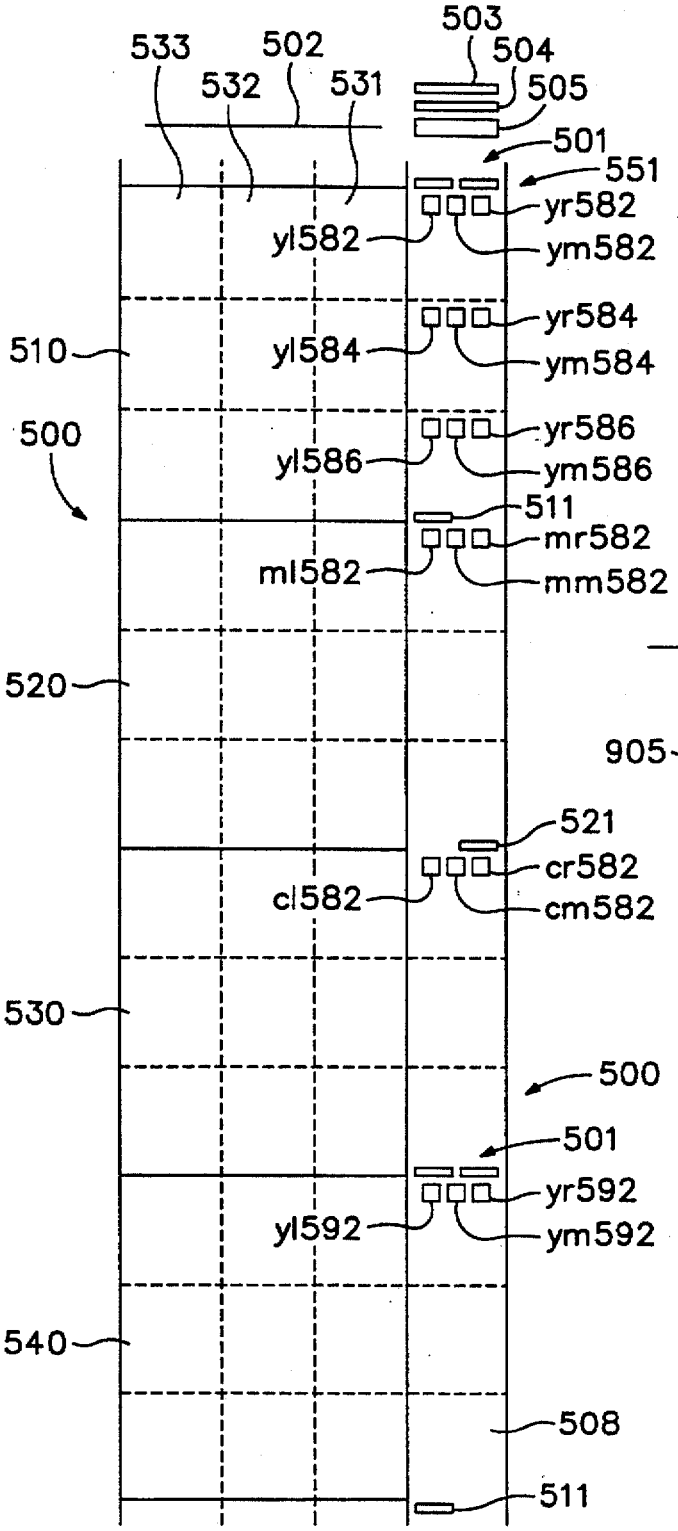
FIG. 5 shows a plan view of a portion of a ribbon partitioned into sectors and including sector marking fields according to the present invention.

A second aspect of the present invention overcomes the foregoing limitation. Referring now to FIG. 5, a ribbon 500 is illustrated having repeating sets of yellow, magenta, and cyan panels (yellow panel 510, magenta panel 520, cyan panel 530 of one set of panel and yellow panel 540 of other set). Optical marks 501, 511 and 521 are marked at the leading edge of each of the yellow, magenta and cyan panels respectively during the manufacturing process. When the optical marks are under the optical sensor 503, the marks are read and the type of panel such as precoat, yellow, overcoat etc. is determined by the microprocessor situated in the printer. The optical marks (e.g. 501) are at predetermined distances from each of the magnetically coated areas 551. Print head 502, read head 504, Write head 505, optical sensor 503 ("devices") are shown schematically in FIG. 5 and these are spatially fixed in relation to each other so that the position of any point of ribbon with respect to any one of these devices also determines the position of the ribbon with respect to all other devices.

Additional marks corresponding to each sector of each panel are marked on magnetically coated areas 551 with a unique mark such as a number after the ribbon is installed. (Instead of magnetic marks, these marks can be bar code, etc.) Thus, mark yl582 (yellow-left), ym582 (yellow-middle) and yr582 (yellow-right) in the marking field 508 correspond to the left top, middle top, and right top sectors 533, 532, and 531 of yellow panel 510, respectively. Marks yl584, ym584, and yr584 correspond to the left central, middle central, and right central sectors of yellow panel 510 respectively. Similarly, marks yl586, ym586, and yr586 corresponds to the left bottom, middle bottom, right bottom sectors of yellow panel 510, respectively. Similarly marks ml582, mm582, and mr582 corresponds to the left top, middle top, and right top sectors of magenta panel 520. Similarly other marks are numbered for each sector of the panels in the set.

For the next set of panels this numbering is continued. Mark yl592, ym592, and yr592 in the marking field 508 corresponds to the left top, middle top, and right top sector of yellow panel 540. The actual markings need not have the form or content such as "yl592"—these are merely reference labels. Any numbering system may be used. It is preferred, however, that reading the mark determines the unique corresponding location of the sector and also relative position with respect to the other marks even though the marks in a ribbon can start from any arbitrary number. Accordingly, each marking includes a unique panel sequence number. According to this aspect of the invention, the magnetic markings are written by the printer rather than predetermined when the ribbon is manufactured. Thus, the printing system (or the user) determines how the ribbon panels are partitioned into sectors. For example, if two-inch wide cards will be printed, the user may partition the ribbon into two-inch wide sectors. Also, these magnetic ribbon markings need not indicate which sectors have been used (although they could serve that purpose as well). Preferably, which sectors have been used (or conversely which sectors remain unused) is indicated in a memory map, described below.

Figure 6:
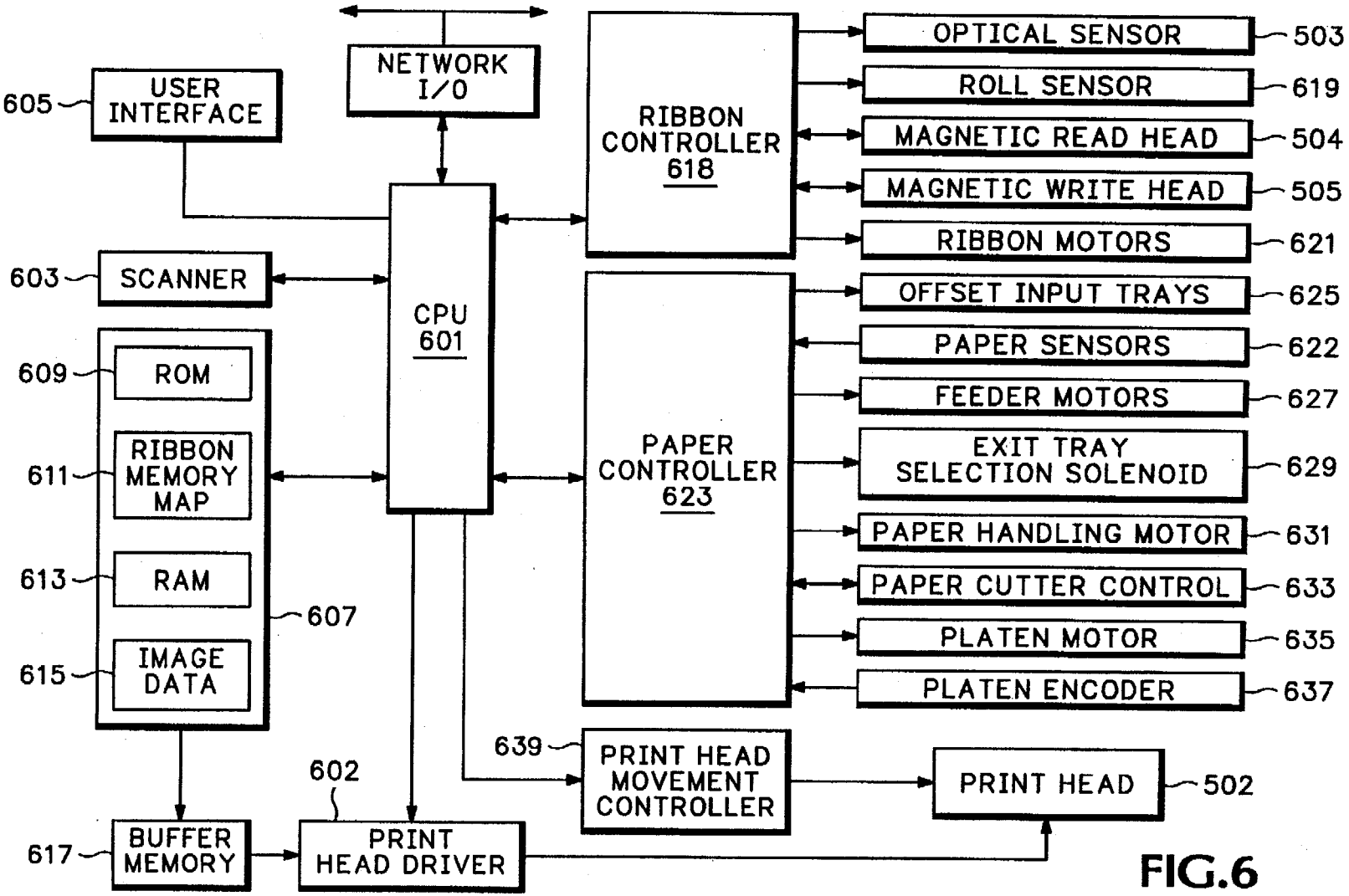
FIG. 6 is a functional block diagram of an illustrative printing system for implementing the present invention.

FIG. 6 is a block diagram of a printing system according to the present invention. Image processing, printing operation, ribbon control, paper controls and other controls are done under the control of the CPU 601 shown in FIG. 6. Devices such as scanner 603 provide the input image data. Alternatively the image data can be created on a PC, captured by digital camera or sent over network to the CPU 601. "Image data" means digital data that describes an image, such as 24-bit CMY bit map image data. User selects the print mode on workstation 605 for printing image 103. CPU interface with memory 607 which comprise of ROM 609 to store read only memory for such purposes as storing the serial number of the printer and operating parameters for printing with each ribbon and print head, memory 611 to store a ribbon memory map to identify used/unused sectors of the ribbon (usually a non volatile memory), RAM 613 for miscellaneous storage and memory 615 for storing the image data. Under the control of the CPU 601, image data is sent to the buffer memory 617 and then the print head drivers 602 selectively energizes print head 502 to print onto a substrate in response to the image data.

Optical sensor 503 detects the optical marks such as 501 and the signals are provided to ribbon controller 618 to determine the position of the edge of the panel with respect to the print elements of the print head. The optical sensor also senses the optical black and white stripes if those are implemented in the marking field of the ribbon. Black and white stripes are counted (or encoder signals, if so used) by the ribbon controller to determine the position of the desired sector from the print head. The mechanical ribbon roll sensor 619 senses the length of the ribbon core to determine the type of ribbon as well as if the ribbon has been replaced since turning off the printer. Ribbon motors 621 are energized for moving the ribbon laterally so that the desired sector of the desired panel of the ribbon is brought in front of selected print elements of the print head (and also used for controlling the ribbon motion during printing.) The motors provide bi-directional ribbon advance and re-wind.

Paper controller means 623 is also controlled by the CPU 601 and in turn senses the presence of the input trays 625, paper or tray offset, and controls selection of the paper tray for feeding by one of the paper feeder motor 627. The paper in the input trays as well as the top edge and (when required) lateral position during its displacement in the printer is sensed by sensors 632.

The prints and substrate (if printing on any substrate is not done or partially done) are collated in appropriate exit trays by operation of a paper guide 1002 by the exit tray selection solenoid 629. Paper sensors monitor the paper position in various parts of the printer and the paper handling motors 631 are energized to move the papers as needed.

The paper cutter controller 633 controls the paper cutter (not shown) to ensure that the paper cutter properly cut the prints because the images may be placed at different locations on the substrate depending upon:

the availability of the unused sector of the ribbon panel;

lateral ribbon movement;

image shift; and/or image rotation for printing.

Each of these features is described below. Platen motor 635 drives the substrate during printing while substrate movement is sensed by the platen encoder 637 mounted on the platen shaft. Print head movement controller 639 presses the print head 502 against the ribbon (the ribbon in turn presses the substrate against the platen) for printing.

Flow Diagram of FIG. *7a–7b*

The user or manufacturer of the printer sets a printer number and also sets an initial ribbon number. These numbers are written into marking fields 582 (FIG. 5) corresponding to the top sectors of each panel of the first set. This initial ribbon number may be different for each ribbon. This allows the printing system to "recognize" a particular ribbon which may have been partially used in the past and to take advantage of the unused sectors, wherever they may be on the ribbon.

Figure 1A:
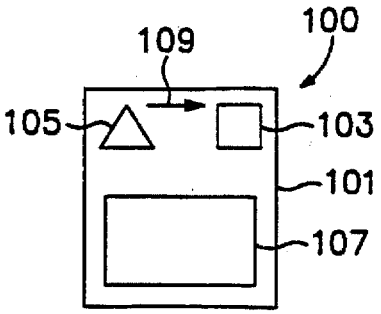
FIG. 1*a* shows a plan view of images on a substrate.
Figure 4:
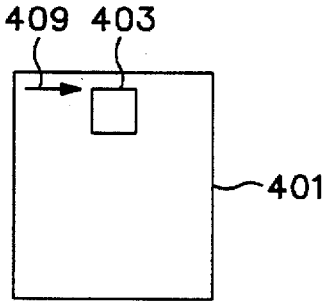
FIG. 4 illustrates in plan view a color image printed on a substrate.
Figure 7A:
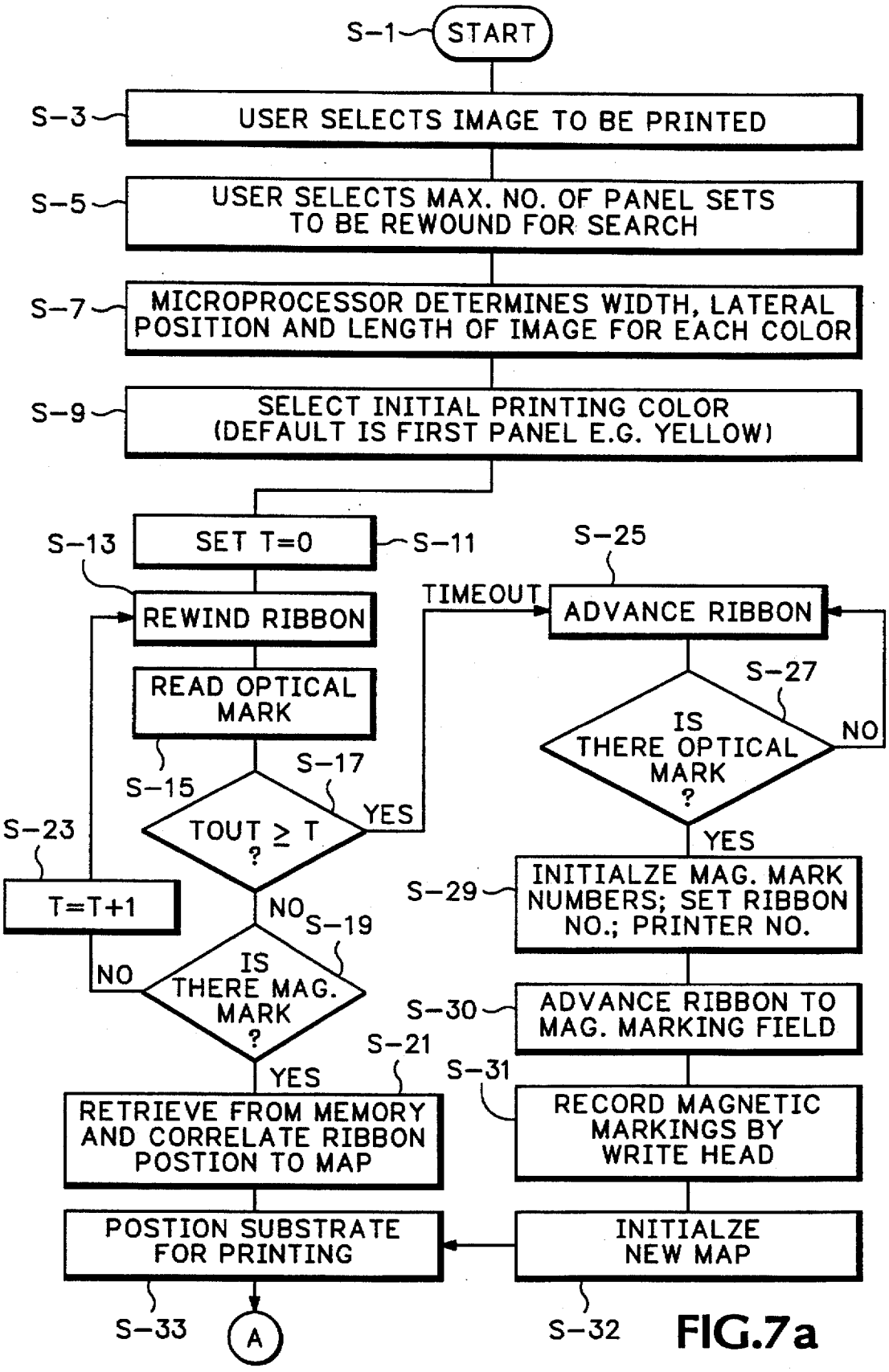
FIGS. 7*a* and 7*b* together form a flow diagram of a methodology according to the present invention for use of previously unused sectors of a ribbon in a printing operation.

A printing operation will be now described using the ribbon shown in FIG. 5 to print images shown in FIG. 1*a* and FIG. 4. A flow diagram is shown in FIG. 7*a* and is continued in FIG. 7*b*. The printer is turned on in step s-1. In step s-3 user selects the image to be printed from his workstation. In step s-5, user selects the maximum number of sets (alternately, number of panels, or length of the ribbon) that can be rewound to make use of any unused sector of the ribbon panels. To make use of unused sectors of a ribbon panel, the ribbon may have to be rewound, which takes time that some users may find excessive. In some application, as the printing progress, all sectors of each panel in a set of panels are completely used up and there is no need to search for unused sectors of panels from the prior sets of panels, and in such a case, the user selects 1 as the number of sets.

Referring next to step s-7, the microprocessor determines the length of the image of each color in the left, middle and right sector. (This assumes the ribbon is partitioned into three sectors across. However, the partitioning step can including selecting a number and arrangement of sectors appropriate for the job at hand. There is no requirement that every panel be divided into like sectors.) In other words, the processor determines the maximum height or length of the image to be printed within the width of each sector (or column of adjacent sectors to the extent that the image exceeds the height of one sector).

For illustration purposes, we continue the 3-by-3 sector example illustrated in FIG. 5. In step s-9 of FIG. 7*a*, the microprocessor sets the first panel for printing. Normally for a full color printing, the first color is yellow (or precoat). In step s-11 a numeric variable or a counter T is initialized to 0, which can be either time or distance tracking.

When the printer is mined on, the position of the ribbon with respect to the print head is not known and therefore it is essential that the position of the ribbon is sensed. To initialize the printer, we search for optical markings indicating the leading edge of a panel set (501 in FIG. 5) or leading edge of an individual panel (e.g. 511 in FIG. 5). In step s-13 the ribbon is rewound on the supply ribbon roll while the Optical Sensor 503 and read head 504 continue to try to read (in step s-15) any optical mark on the ribbon's marking field. While we refer to optical markings and sensors in the example, other marking means can be used. In general, optical markings here means markings applied to or formed on a ribbon before it is installed in the printer—generally during manufacture. Such "optical markings" are distinguished from markings and numbering applied to the ribbon while it is installed in the printer, as disclosed herein. We describe these new markings as being magnetic, as this is a useful example, but again other marking means could be used.

In step s-17, it is determined if T is greater than TOUT which usually corresponds to time required to move one set of panels. If T is not greater than TOUT then in step s-19, it is determined if a magnetic mark is read. When a magnetic mark is recognized by the magnetic read head 504, then in step s-21, the corresponding used/unused ribbon map is retrieved from the memory and the position of the print head (and the read head etc.) with respect to any sector is thereby uniquely determined. If no magnetic mark is detected, in step s-23 the value of T is incremented; the ribbon is further rewound s-13; the optical sensor checked s-15; test again for timeout s-17, etc. If a magnetic marking is found, proceed to s-21 as before. If T exceeds TOUT as detected in s-17, where TOUT a predetermined maximum timeout value, then it is determined that in spite of allowing sufficient time to rewind the ribbon, magnetic marks have not been read and therefore, the system concludes that either it is a new ribbon or there is no ribbon. If T is greater than TOUT, then the next step is s-25 on the right side of FIG. 7*a*.

In step s-25, the ribbon is advanced (wound on the take up roll) by a predetermined distance (a relatively short distance relative to the length of a panel). In step s-27 check for an optical mark to indicate the top edge of the first panel. If no mark is detected, the ribbon is again advanced incrementally and in step s-25 and again in step s-27, it is determined if there is a mark read by the optical sensor. When an optical mark is read in step s-27, then in step s-29 magnetic marking values are initialized. Preferably these values represent: (1) a ribbon identification number; (2) a printer identification number; and (3) a unique panel or sector or row of sector numbers. The ribbon is advanced if necessary to locate the first set of magnetic marking areas 551 under the marking or write head 505 (FIG. 5). In step s-31, the magnetic marks are recorded on the first set of magnetic marking area 551 (FIG. 5). Note we use a set of marking areas—at least two—each corresponding to a respective sector of the ribbon panel to uniquely identify such separately. However only one unique marker is sufficient. A new ribbon map is initialized in memory, step s-32. The memory map reflects the numbers recorded on the ribbon, i.e. the unique panel or row of sectors or sector numbers written on the ribbon itself magnetically.

NOTE: The new ribbon usage map must reflect the sector definition—i.e. sizes, location and arrangement of sectors; defining how each panel is partitioned. This may be determined (1) by default values, e.g. always 3×3 sectors per panel; (2) by values selected according to the type or size of ribbon installed; or (3) under user control, e.g. from application software or front panel switch or network printer controller. This will allow the user to define sectors as appropriate for the application at hand. Finally (4), the printing system itself can define the sectors based on analysis of the image data.

In step s-33, the substrate is moved until the print head is slightly ahead of the top edge shown by arrow 109 of the substrate 101 to be printed as illustrated in FIG. 1*a*.

Figure 7B:
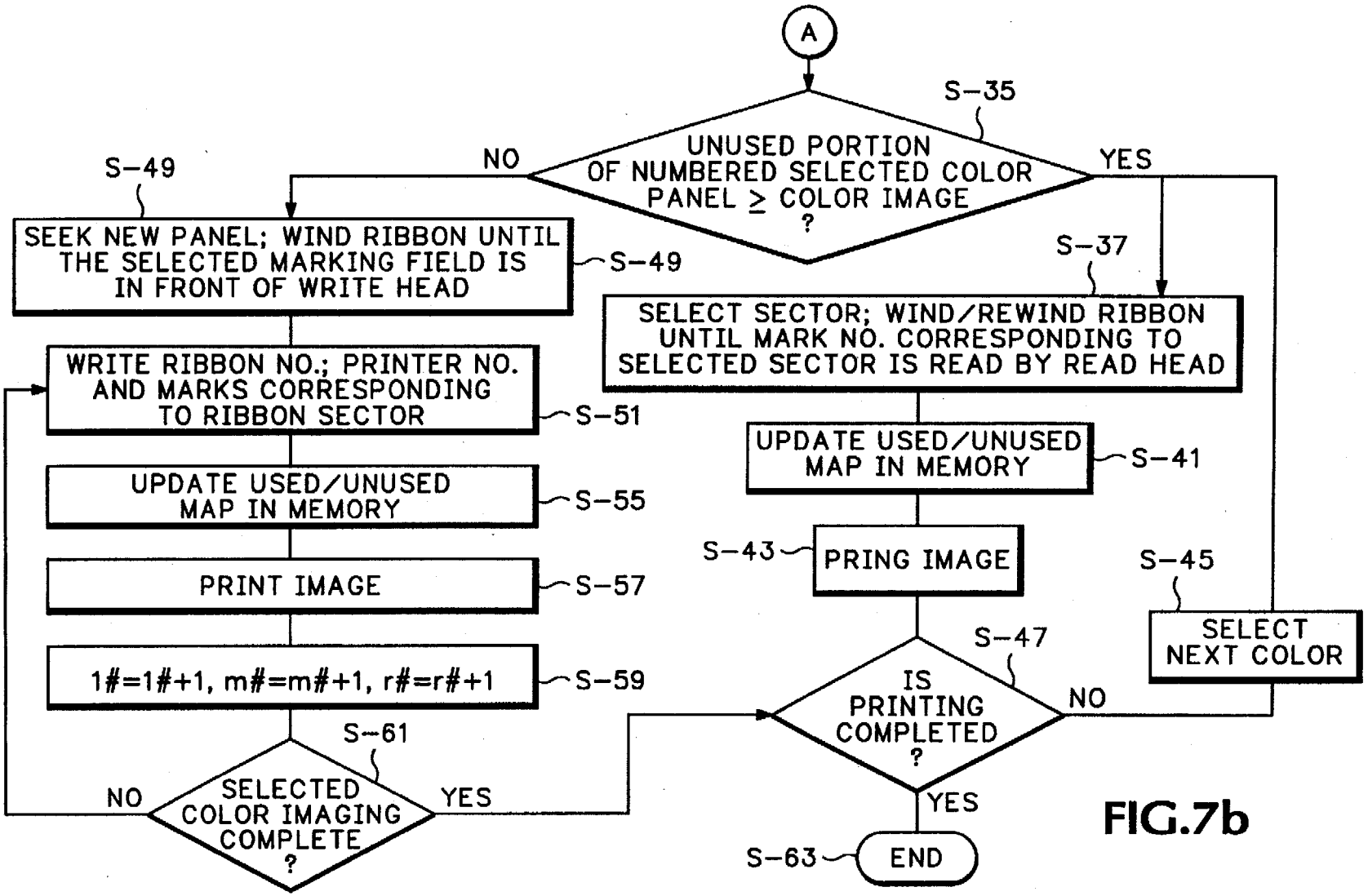

Turning now to FIG. 7*b*, the installed ribbon has been identified and the corresponding ribbon usage map either retrieved from memory or, in the case of a new ribbon, created in memory. In step s-35 in FIG. 7*b*, the present methodology calls for comparing the length, width and lateral position of the image to be printed (referring now only to the selected color plane (see s-9) as each color is considered separately) to the unused sectors of the current panel as defined above, to determine whether or not any one unused sector itself, or a contiguous combination of unused sectors of the current panel together, provides a ribbon area adequate for printing that image. (For a continuous image (such as a photograph), printing only a portion of the image by an insufficient unused portion of the panel and then printing the rest of the image by another portion of the ribbon may cause a discontinuity in the image.) If so, proceed to step s-37 for selecting the appropriate unused sector and moving the ribbon as necessary to position it for printing using the selected sector. If there is a sufficient unused sector of the ribbon available within the maximum number of panels (which was set in step s-5) from its present position, then in step s-37, the ribbon motor is energized so that the ribbon is moved until the selected sector mark is read by read head.

For example, referring to FIG. 5, it is determined that the right top yellow sector corresponding to yr582 is used up when image 103 was printed earlier; however yellow sectors corresponding to yl582 and ym582 are not used up and therefore the left top and middle top sectors are available for printing image 403. The ribbon is moved a specified distance (i.e. until specified number of encoder signal are sensed) until the print head is just ahead of the top edge of sector 532. In step s-41, the map of the unused/used sector of the panel is revised using planned use of the sector 532 for printing. Thus, the revised used/unused map now indicates that middle top yellow panel sector 532 is used up.

In step s-43, image 403 is printed. In step s-47, it is determined if all color printing is completed and if the imaging is not completed, then in step s-45, the next color is selected and the steps are repeated from step s-35. If the image printing with all color panels is completed, then the next step is s-63 and the printing of that image is completed.

In step s-35, if all unused sectors of numbered panels are smaller than the continuous image of the selected color within a maximum number of panel sets (which was selected in step s-5), then the next step is s-49. In step s-49, the ribbon is wound on the take up roll until the next optical mark of the selected color panel is sensed and then the ribbon is moved until the selected marking field is in front of write head. In step s-51, write head 505 writes ribbon number, printer number and next ribbon sector number yl582, ym582, yr582 on the magnetic area in the marking field while the ribbon is moved. The ribbon is moved by a specified distance (i.e. until specified number of encoder signals are sensed) until the print head is slightly ahead of the top of the unused sector of the ribbon. In step s-55, considering the image length to be printed is now printed (i.e. for left, middle and or right sector of panel) the map of unused/used ribbon is updated. Here, since image 103 is to be printed, mark yr582 corresponding to the right top sector of the yellow panel is considered used up. In step s-57, image 103 is printed for the selected yellow color. (Note that if printing uses any portion of a sector, then the sector is considered as used up for the revision of the used/unused ribbon map.) In step s-59, the set number of the marks are revised by addition of 1. Here the next number for the mark for yellow panel are set as yl584, ym584 and yr584. In step s-61 it is determined if the selected color imaging is completed. If the selected color imaging is completed then preferably the marks for the selected panel are marked for all sectors and the next step is s-47. If the color imaging is not completed, then the next step is s-51 for printing with additional sectors.

Note that since this method uniquely determines each sector of the panel, if any sector is unused, then this information is available and the microprocessor in the printer determines how the ribbon motor is to be energized (while using encoder signal to determine the distance from the last known position) to access this unused sector to print another image. If this important information is not known, then finding the unused sector, is a random and time consuming procedure with unpredictable results.

Figure 8:
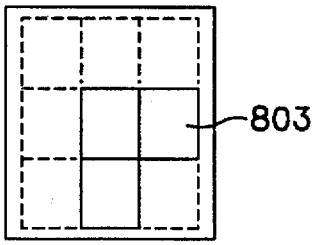
FIG. 8 shows a plan view of a color image printed by using adjoining sectors printed on a substrate.

Another important aspect of this method is the ability of the microprocessor to compare the size of the image with size and positions of the unused sectors to find the correct size and position of the unused sectors for printing. For example, image 803 shown in FIG. 8 can not be printed by used panel 317 and therefore another panel is searched for proper size of sectors for printing.

Note that optical marks 501 at the beginning of each yellow panel, mark 511 at the beginning of each magenta panel and mark 521 at the beginning of each cyan panels are identical for each set of color panels and therefore the microprocessor can not discriminate one set of color panel from another set of color panels by determining the presence of these marks. The optical marks are at a predetermined distance from each of the magnetic marks such as yl582, ym582, yr582, yl584, etc. The magnetic area can be 0.5 mm stripes with a gap of 2 mm between stripes and such stripes of the magnetic marks when marked, can be used to determine the relative position of the print head and the ribbon sector. These novel magnetic stripes positioned at known distance from each other, when sensed, can determine the position of the ribbon sectors without the need for additional optical stripes or encoder to position any sector of ribbon accurately. Initially there is no number assigned at this magnetic areas (this number is not assigned during manufacturing of the ribbon in applicant's co-pending application Ser. No. 08/236,423; however the number is assigned during manufacturing in the applicant's co-pending application Ser. No. 08/039,871 and this is the difference in the methods and either methods can be used) and therefore the read head does not read any number. After this is verified by the read head 503, then the ribbon is moved until the write head 505 is above the magnetic area and at that time, numbers yl582, ym582, and yr582 are marked on the magnetic area 551. For a newly installed ribbon, the printer assigns a number for the ribbon and additionally the ribbon number and printer's number are marked along with the numbers yl582, ym582, and yr582 on the magnetic area 551 to facilitate sensing of the ribbon.

Elaboration and Extension of the Method

Instead of the three marks yl582, ym582, and yr582, only one mark (such as y582) is used for the top sectors of the first ribbon panel. Even though there is only one mark for the top three sectors of the panel in this method, the mark y582 is uniquely sensed which corresponds with the top three sectors and in the microprocessor a map is made to map each left, middle and right sectors.

Furthermore, only one mark y582 for the top sector of the yellow panel can be used without marking the additional marks y584 and y886 for the central and bottom sectors, and these sectors can be identified by reading panel mark y582 and then moving the ribbon while the encoder provides pulses so that the distance of such movement can be computed. Thus the ribbon can be moved after sensing the unique mark by the computed distance until the desired sector of the panel is under the print head. The problem with this method is that in case of a power failure, the ribbon needs to be rewound until mark y582 is read to determine the position of the ribbon and then the ribbon needs to be moved again for use. Also, to minimize positioning errors, it is preferred to sense a mark near sectors to be printed.

It is also possible to divide the ribbon in very small sectors and make marks for each small sector of the ribbon panel. For example, a mark can be made for each 1 mm×5 mm sector of panel.

Also the mark may represent more than one discrete sector of ribbon panel. For example, in FIG. 1*b*, there are 12 pictures 113 situated at a fixed distance from each other and are significantly apart from each other. A single mark 224 for all these sectors for each color panel (or set of panels) can be used to indicate that ribbon panel 222 (or set of panels) is used in the 12 discrete areas 223 shown in FIG. 2*c*.

A wide ribbon does not always move accurately and sometimes a lateral displacement is possible during the ribbon winding or printing. Two or more marks situated side by side are made to indicate the same information so that if one mark is not below the read head 505, the other mark, with identical information, can be under the read head so that the information can be read. Alternately, two read heads can be positioned in the printer so that in spite of ribbon's lateral movement, one of the head will be able to read the mark. Also because of the inaccuracies of accurately positioning the ribbon, a small (e.g. 1 mm) gap is kept between the portions of ribbon used so that in normal operation, printing with used portion of the ribbon will not happen. There are multi-print and "stretch" type ribbons which can print longer images than the length of ribbon and can also be used similarly in this method by including the extend of use in the map.

Image Shift to Make Use of Used Sectors of Ribbon

Figure 1B:
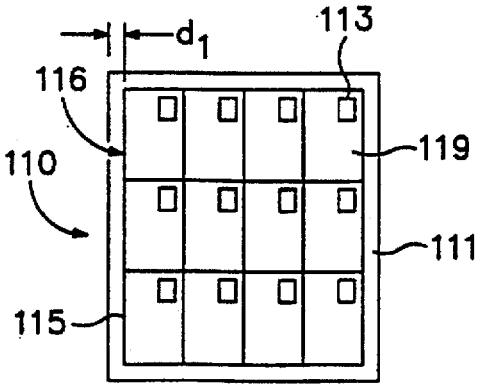
FIG. 1*b* shows a plan view of a multiple discrete color sub-images printed on a substrate.
Figure 2A:
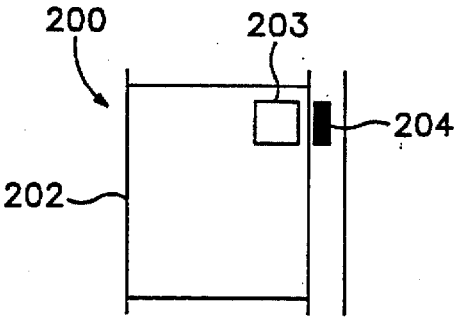
FIG. 2*a* shows a plan view of a ribbon illustrating one used portion of the ribbon (corresponding to a color portion of the color image of FIG. 1*a*) and illustrating a corresponding "used mark" in the margin of the ribbon according to the prior art.
Figure 2B:
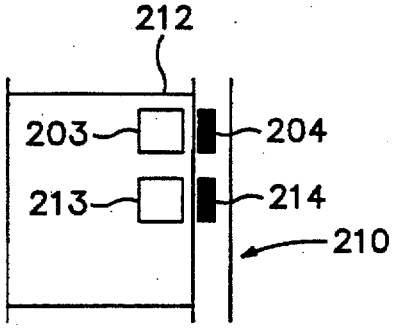
FIG. 2*b* shows a plan view of a ribbon panel illustrating two used portions of the ribbon and two corresponding "used marks" according to the prior art.
Figure 2C:
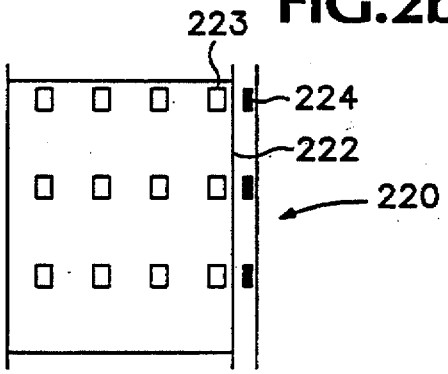
FIG. 2*c* shows a plan view of a ribbon panel illustrating 12 discrete used sectors of the ribbon and a corresponding "used mark" alongside each used portion according to the prior art.
Figure 2D:
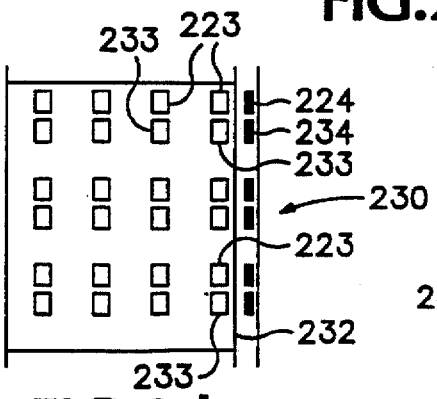
FIG. 2*d* shows a plan view of a ribbon panel including two sets of 12 discrete used sectors of the ribbon and six corresponding "used marks" according to the prior art.
Figure 2E:
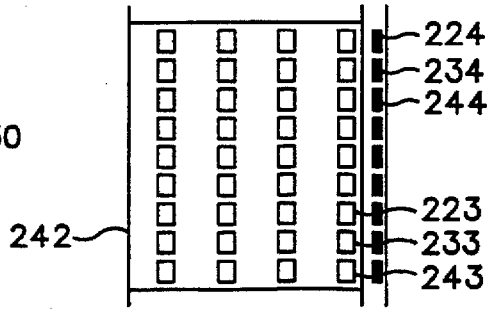
FIG. 2*e* shows a plan view of a ribbon panel including three sets of 12 discrete used sectors of the ribbon and nine corresponding "used marks" according to the prior art.
Figure 9A:
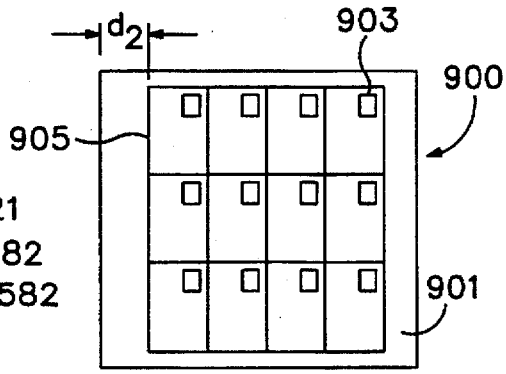
FIG. 9*a* shows a plan view of a color image printed by unused sectors of the ribbon panel shown in FIG. 2*e* after laterally shifting the image according to one aspect of the invention.
Figure 9B:
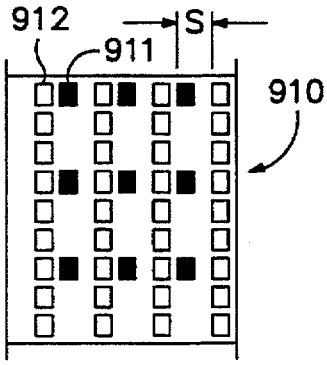
FIG. 9*b* illustrates a ribbon panel after printing the shifted image of FIG. 9*a* using the ribbon shown in FIG. 2*e*.

There are many applications such as business cards or security I. D. cards in which the relative position of the color picture on the card is fixed. For example, image 103 of a business card is situated on the right hand side of the prints 100 and it is not acceptable to print image 403 in the center. Though the novel method described above enable using unused sectors of the ribbon panel, the shortcoming can be seen when all of the images are required to be printed only on the right hand side (as shown in FIG. 1*b*). The unused sectors on the left side of the used sectors 223, 233 and 243 remain unused and can not be used to print another color image which requires printing on the right hand side of the print. To make use of the unused sectors of the panel situated on the left of used sectors of the panel shown in FIG. 2*e*, in this novel method the image data is shifted by the microprocessor to the left by distance "S " as shown in FIG. 9*b*. When such a shift of image is done, the relative position of these images (i.e. images 103, 105 and 107) with respect to each other remains the same. The print 900 includes such 9 color images 903 printed (by shifting the color image) on substrate on 901 and are shown in FIG. 9*a*. Note that the unused sectors such as 911 shown in FIG. 9*b* were used to print images 903. This method to shift the image data therefore results in printing 9 additional color images from the used panel 242. Similarly an additional 18 (9+9) color images can be similarly printed resulting in a total of 27 pictures on the 27 business cards 905 by using the unused sectors of the ribbon panel 242. However in this method, the sector of ribbon panel situated on the left of sector 912 (and others below it) still can not be used for printing such picture images and therefore results in the wastage of that portion of the ribbon material.

Figure 10A:
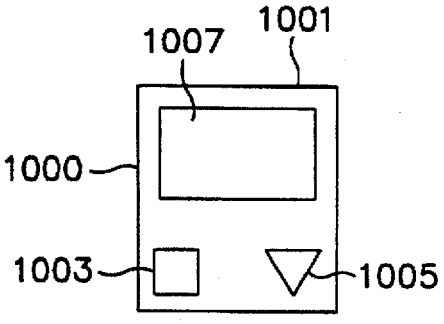
FIG. 10*a* shows a plan view of the image shown in FIG. 1*a* after rotation to reduce ribbon waste according to another aspect of the invention.
Figure 11A:
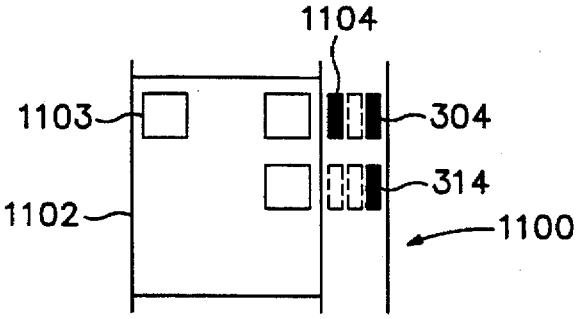
FIG. 11*a* shows a plan view of the ribbon panel of FIG. 3*b* after an additional sector of the ribbon is used for printing the rotated image of FIG. 10*a*.

Rotation of Image When Images Are to be Positioned on Same Location in Prints According to this invention, the image data to be printed (such as color images 103, texture image 105 and b/w image 107 together) is rotated in the microprocessor so that the color image 1003 is printed on substrate 1001 as shown in FIG. 10*a* by unused sector 1103 corresponding to mark 1104 of panel 1102 as shown in FIG. 11*a*. FIG. 10*a* shows the print 1000 which includes the color image 1003 (and also texture image 1005, and b/w image 1007) printed on substrate 1001. Similarly the unused left sectors of panel 212 shown in FIG. 2*b* can be used to print color image 1003 by rewinding the ribbon supply roll after printing and then printing with the unused sector of the panel.

Figure 10B:
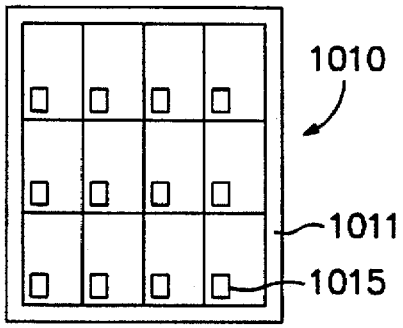
FIG. 10*b* shows a plan view of the image of FIG. 1*b* after rotation of the image to reduce ribbon waste according to another aspect of the invention.
Figure 11C:
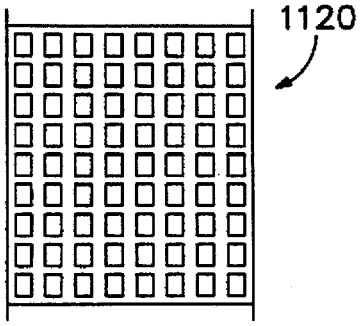
FIG. 11*c* shows a plan view of a ribbon panel after using all sectors for printing the discrete images.
Figure 11B:
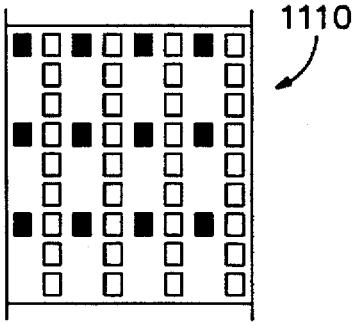
FIG. 11*b* shows a plan view of a ribbon panel illustrating used sectors of the ribbon after printing image of FIG. 10*b* by used ribbon shown in FIG. 2*e*.

This rotated image can also be printed by unused sector 533 shown in FIG. 5. Similarly the unused sectors situated left of the used sectors 223, 233 and 243 shown in FIG. 2*e* can be used to print 12 color images 1015 shown in FIG. 10*b*. This printing can be again repeated twice so that a total of 36 such color images 1015 can be printed from the partially used ribbon panel 242. After printing 36 additional such color images 1015, the color panel is fully used up and is shown in FIG. 11*c*.

When the image such as black image 107 is printed, half of the black panel is used up. In this example one black panel is therefore required to print black images 107 and 1007. The texture image 105 requires the left half of the top, left half middle or the left half bottom sector of the panel for printing. Similarly the rotated texture image 1005 can be printed from the unused right sectors of a texture panel ribbon which significantly reduces the ribbon waste. It is also sometimes desirable to print with precoat before printing with yellow, magenta and cyan color panels to print on a variety of substrates and if the ribbon panels are of dye diffusion, to protect from light fading, overcoat may be applied. These texture, black, precoat and/or overcoat can be separate ribbon or can be part of yellow, magenta and cyan ribbon panel set. For flexibility in printing, black, texture, precoat, overcoat etc. ribbon panels can be part of a separate ribbon (s) which can be printed either by the same or additional print heads.

Stacking in Two Trays

Since print 100 is not rotated and print 1000 is rotated (to make use of the unused sectors of ribbon panels), it is not convenient for users to stack prints 100 and prints 1000 together in one tray. Similarly, since the prints 110 are not rotated and prints such as 1010 are rotated it is not convenient for users to stack these prints in one tray. If these prints are stacked together, the user will have to manually collate those to put the right side up to read. Similarly color images 113 in prints 110 are not shifted, but the color images 903 in print 900 are shifted and it is not convenient for users to stack these prints in one tray. Sometimes, these large prints (e.g. each having several cards) may be cut in the cutting machine after printing and the alignment of images with edge of paper may not be the same for the rotated images. Two separate paper exit trays are used so that one type of prints (such as rotated prints) can be stacked in tray 1004 whereas other type of prints (such as non rotated prints) can be stacked together in tray 1002. Solenoid controlled guide 1006 is controlled by a microprocessor so that unrotated images and rotated images can be stacked together in the different trays. Alternately, paper handling to rotate the rotated prints can be incorporated to stack the print all with right side up.

Instead of stacking in two different paper exit trays, an automatic paper cutter programmed to compensate for such image shift can be installed at the exit end to align the cutter. FIG. 1*b* shows the left edge of the first row of cards which is d1 distance from the left edge of the substrate 111 when there are 4 rows of cards and the paper cutter edge is set to begin cutting from this edge. FIG. 9*a* shows the left edge of the first row of cards which is d2 distance from the left edge of the substrate (when there are only 3 rows) and in such case the paper cutter edge is set to begin cutting from this edge.

This method of conserving ribbon panels dramatically expands thermal printing applications. Furthermore two or more ribbons can be used as described by the present applicant's co-pending application Ser. No. 08/047,144 filed Apr. 12, 1993; and co-pending application Ser. No. 08/057,538 filed May 4, 1993.

Printing Without Rotation-Moving Ribbon Situated on Carriage

Figure 12B:
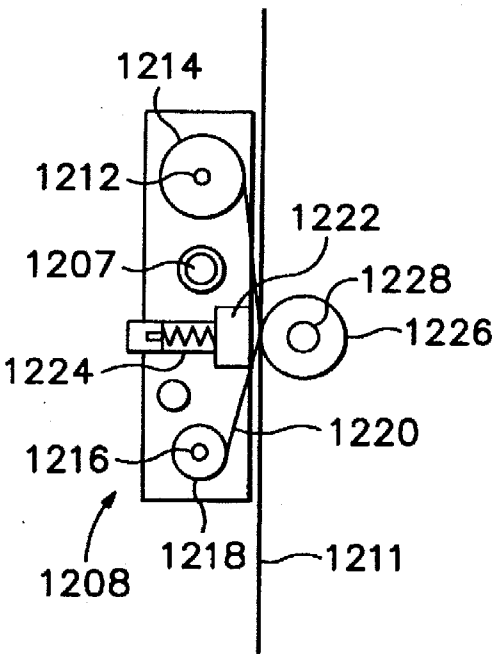
FIG. 12*b* is a cross-sectional view taken along line 12B'-12B of FIG. 12*a*.
Figure 12A:
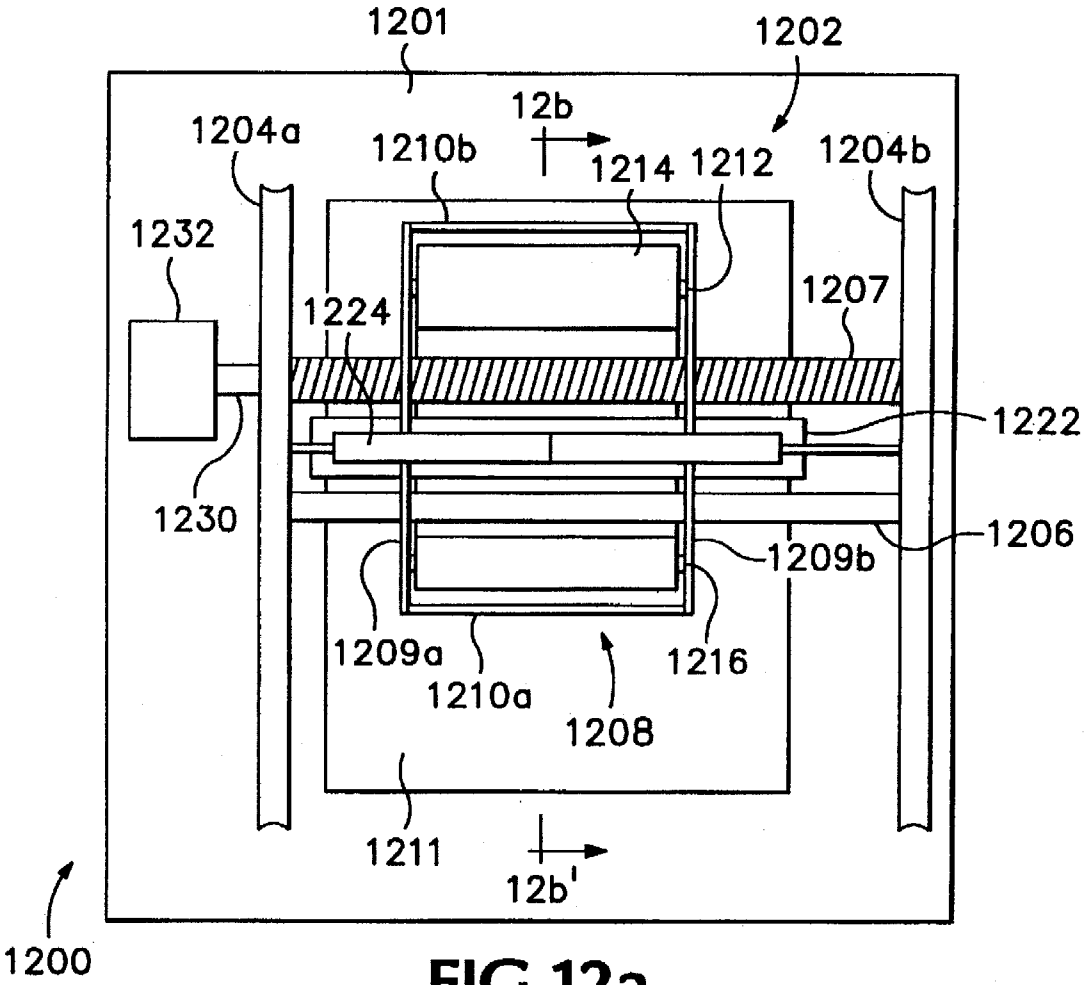
FIG. 12*a* illustrates a mechanism for providing control of the lateral positioning of a ribbon relative to a substrate.

To position any portion of the ribbon against the area on the paper to print an image, the ribbon as well as the print head can be moved as described in this applicant's co-pending application Ser. No. 08/057,538 filed May 4, 1993. Alternately, only the ribbon assembly can be moved and the print head is kept stationary. A mechanism for such lateral positioning of a carriage which bears only the ribbon is shown in FIG. 12*a* and FIG. 12*b* in this application. This is similar to FIG. 5 of this applicant's co-pending application Ser. No. 08/057,538 filed May 4, 1993, except the print head is attached to the printer frames 1204*a* and 1204*b* and only the ribbon 1220 together supply roll 1214 and take up roll 1216 are moved by the carriage 1208. For simplicity, the 5xx numbers of the above mentioned applicant's Application are replaced by 12xx in the FIG. 12*a* and FIG. 12*b* of this application. Specifically, ribbon positioner 1200 as mounted on printer frame 1201 is shown in both a top plan (FIG. 12*a*) and a cross-sectional (FIG. 12*b*) view taken through the line 12B and 12B' of FIG. 12*a*. Image positioner 1200 includes a carriage frame 1202 that is fixedly mounted to printer frame 1201 by means of first and second frame members 1204*a*, 1204*b*, which are in turn interconnected by cross member 1206 which is fixedly mounted therebetween, and by threaded bolt 1207 which is rotatably mounted therebetween. Carriage 1208, which principally comprises two parallel plane members 1209*a*, 1209*b* and first and second struts 1210*a*, 1210*b* is slidably mounted to cross member 1206 and screwably mounted to threaded bolt 1207 and provides the desired positioning action. As can be seen in FIG. 12*a*, carriage 1208 is positioned to lie "above" a sheet of substrate 1211.

Carriage 1208 further comprises supply shaft 1212 disposed transversely between members 1209*a*, 1209*b* and onto which supply roll 1214 is rotatably mounted, take-up shaft 1216 which is likewise disposed transversely between members 1209*a*, 1209*b* and onto which take-up roll 1218 is rotatably mounted, and ribbon 1220 which is disposed between supply roll 1214 and take-up roll 1218 in the usual fashion. The print head 1222 which faces ribbon 1220 in the usual manner and is controlled in terms of motion towards and away from ribbon 1220 by a springloaded motor 1224 that is mounted to the first and second frame members 1204*a* and 1204*b*. A platen 1226 or the like (which is "behind" substrate 1211 and thus not seen in FIG. 12A) is rotatably mounted to frame 1201 by shaft 1228 and faces towards substrate 1211 so that the ribbon 1220 is pressed against substrate 1211 by print head 1222 as usual.

Positioning of the assembly that includes supply roll 1214, take-up roll 1218, ribbon 1220 and which thus defines the transverse or lateral location of any ribbon panel sector on substrate 1211 at which print head 1222 will act to transfer an image, is controlled by rotation of threaded bolt 1207, which as indicated passes through a like set of threads within carriage 1208 and is rotatably connected at respective ends thereof to first and second frame members 1209*b*, 1209*a*. As one means of rotating threaded bolt 1207, FIG. 12*a* shows an extension shaft 1230 which extends outwardly from first frame member 1204*a* and onto the end of which is located knob 1232 which can be manually turned so as to turn threaded bolt 1207. Of course, rotation or turning of threaded bolt 1207 can optionally be controlled by a motor. In the embodiments of FIGS. 12 any of above images can be placed at any desired lateral location across the width of the substrate. By controlling the timing by which print data are sent to the print head, a desired placement along the length of the substrate is also achieved in the usual manner.

According to this method as shown in FIG. 12*a* and FIG. 12*b* of this application (as well as that shown in FIG. 4 and 5 of this applicant's co-pending application Ser. No. 08/057,538 fled May 4, 1993) if a print job requires printing all of the images on the left hand side, then even the right hand side sector of the unused ribbon panel can be used by moving the ribbon assembly to the left and printing with the unused right sector of the ribbon. However this method requires moving the ribbon assembly, and this additional mechanism increase the cost significantly.

Positioning the Substrate

Figure 13:
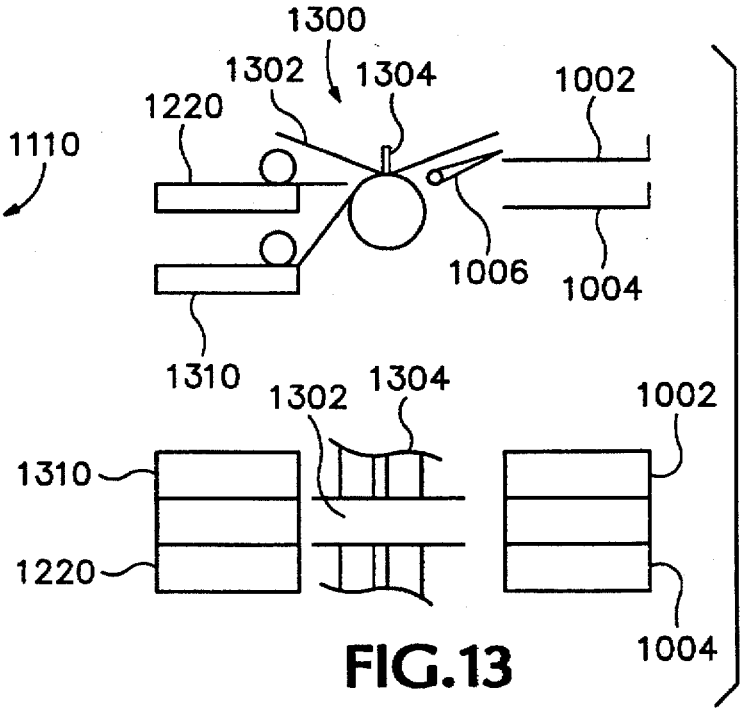
FIG. 13 is a printer in which the substrate can be laterally moved while the ribbon and print head are fixed.

Instead of moving the ribbon as described above, the substrate can be moved or paper cassettes can be laterally positioned to position the paper laterally so that the image can be printed at any desired lateral position by any sector of panel. In FIG. 13, printer 1,300 is shown in which lateral position of the ribbon 1302 and print head 1304 is fixed. Paper tray 1220 is shown situated in the central location laterally so that when a right sector of the ribbon is used to print an image on substrate fed from this tray, then the image is printed on the right side. Paper tray 1310 is situated to the left so that the left sector of the panel also prints image on the right side of the substrate. Similarly, additional input paper trays can be installed at different lateral position to enable positioning of the image in any lateral position on substrate. It may be desirable to have more than one exit paper tray to collate the images fed from these two paper trays or the paper transport can move laterally to collate the substrate from these paper trays.

Though this method is described by making a mark with the write head, as described above, if a unique mark such as number if already marked during manufacturing of the ribbon to indicate a row of substrate or top of panel, then this method can be similarly used.

Having illustrated and described the principles of my invention in a preferred embodiment thereof, it should be readily apparent to those skilled in the art that the invention can be modified in arrangement and detail without departing from such principles. I claim all modifications coming within the spirit and scope of the accompanying claims.

I claim:

1. A method of improving ribbon usage in a non-impact color printer having a continuous ribbon installed in the printer, the ribbon comprising at least one panel of transfer material of predetermined width for transferring a predetermined image onto a substrate such as a sheet of paper, the method comprising the steps of:

selecting a predetermined image to be printed onto a substrate using the installed ribbon;

partitioning the panel of the ribbon so as to define an plurality of sectors, at least one of the sectors including a region having a width less than a total width of the panel, whereby said region extends laterally adjacent to another sector of the same panel;

determining a size and a location of the image to be printed;

selecting one or more unused sectors of the panel that provide an area of the panel having adequate size and location for printing the image;

printing the image onto the substrate using the selected sectors; and then recording an indication of usage for each of the sectors that it is used for printing, thereby defining used and unused sectors of the panel.

2. A method according to claim 1 wherein said recording step includes marking an indication on the ribbon of which of the sectors are used.

3. A method according to claim 1 wherein said recording step includes storing an indication in a memory of which of the sectors are used.

4. A method according to claim 1 further comprising:

printing a second image that extends into an area laterally adjacent to the first image by using one or more of the unused sectors of the same panel.

5. A method according to claim 4 further comprising identifying a sector group consisting of a minimum number of contiguous, unused sectors that provide a ribbon area of adequate size and location for printing the second image.

6. A method according to claim 5 wherein the ribbon comprises a plurality of panel sets and said identifying step is limited to identifying a sector group within a predetermined maximum number of panel sets away from the present panel set.

7. A method according to claim 1 wherein said partitioning step includes partitioning the panel so as to define a generally rectangular array of sectors.

8. A method of printing in a non-impact color printer having a print element and a ribbon installed in the printer, the ribbon comprising at least one panel of thermal transfer material of predetermined width for transferring an image onto a substrate such as a sheet of paper, and the ribbon having been partially used, the method comprising the steps of:

selecting a predetermined image to be printed onto the substrate using the installed ribbon, the selected image having a width less than the unused portion of the panel;

laterally shifting the selected image relative to the print element so as to align the image with the unused portion of the panel; and then printing the selected image using the unused portion of the panel, thereby using a portion of the panel laterally adjacent to a previously used portion of panel.

9. A method of printing in a non-impact color printer having a ribbon installed in the printer, the ribbon comprising at least one panel of thermal transfer material of predetermined width for transferring an image onto a substrate such as a sheet of paper, and the ribbon having been partially used, the method comprising the steps of:

selecting a predetermined image to be printed onto the substrate using the installed ribbon, the selected image having a width less than the unused portion of the panel;

rotating the selected image;

printing the rotated image using the previously unused portion of the panel, thereby using a portion of the panel.

* * * * *